US008539729B2

(12) United States Patent
Lynch et al.

(10) Patent No.: US 8,539,729 B2
(45) **Date of Patent: *Sep. 24, 2013**

(54) DOOR, METHOD OF MAKING DOOR, AND STACK OF DOORS

(75) Inventors: Steven K. Lynch, St. Charles, IL (US); Robert C. Allen, Elburn, IL (US); Greg Wysock, Sycamore, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/312,125

(22) Filed: Dec. 6, 2011

(65) Prior Publication Data

US 2012/0076993 A1 Mar. 29, 2012

Related U.S. Application Data

(63) Continuation of application No. 12/917,530, filed on Nov. 2, 2010, now Pat. No. 8,069,627, which is a continuation of application No. 11/284,130, filed on Nov. 22, 2005, now Pat. No. 7,823,353.

(51) Int. Cl.
*E06B 3/70* (2006.01)

(52) U.S. Cl.
USPC ..... 52/455; 52/784.1; 52/592.6; 52/574

(58) Field of Classification Search
USPC ..... 52/455, 456, 311.1, 316, 574, 592.6, 52/783.1, 783.12, 783.15, 784.1, 789.1
See application file for complete search history.

(56) References Cited

U.S. PATENT DOCUMENTS

| | | | | |
|---|---|---|---|---|
| 5,074,087 | A * | 12/1991 | Green | 52/309.9 |
| 5,782,055 | A * | 7/1998 | Crittenden | 52/784.1 |
| 6,200,687 | B1 * | 3/2001 | Smith et al. | 428/537.1 |
| 7,426,806 | B2 * | 9/2008 | Lynch et al. | 52/455 |
| 7,644,551 | B2 * | 1/2010 | Crittenden | 52/455 |
| 2001/0029714 | A1 * | 10/2001 | Lynch et al. | 52/309.13 |
| 2004/0003560 | A1 * | 1/2004 | Lynch et al. | 52/311.1 |
| 2004/0035085 | A1 * | 2/2004 | Crittenden | 52/784.1 |

* cited by examiner

*Primary Examiner* — Jessica Laux
(74) *Attorney, Agent, or Firm* — Berenato & White, LLC

(57) ABSTRACT

A door, method of making a door, and stack of doors includes providing a door having front and back skins that have differing, but complementary profiles, one for the front side of the door and one for the back side of the door where each allows and fits onto the other, while still providing direct contact in the stile and rail zones of the door permitting conventional door layup practices.

15 Claims, 7 Drawing Sheets

DOOR, METHOD OF MAKING DOOR, AND STACK OF DOORS

CROSS-REFERENCE TO RELATED APPLICATIONS AND CLAIM TO PRIORITY

This application is a continuation of application Ser. No. 12/917,530, filed Nov. 2, 2010 now U.S. Pat. No. 8,069,627, which is a continuation of application Ser. No. 11/284,130, filed Nov. 22, 2005 now U.S. Pat. No. 7,823,353, the disclosure of which is incorporated herein by reference and to which priority is claimed under 35 U.S.C. §120.

FIELD OF THE INVENTION

The present invention relates a door, a method of making a door, and a stack of doors. More particularly, the present invention relates to a door, method of making a door, and stack of doors, wherein the door includes door skins having differing, but complementary profiles, which allow the doors to be stacked during manufacturing or shipping without requiring the needs for spacers.

BACKGROUND OF THE INVENTION

Man-made boards, such as fiberboard, e.g., medium density fiberboard; hardboard; chipboard; oriented strand board-fiberboard composites; particle board; oriented strand board-particle board composites; and the like, may be formed into articles having contoured portions simulating stiles, rails, panels, or other desired features of a door facing or skin. Such articles may be formed to include one or more interior depressions or raised contours simulating panels or other decorative features. Such formed depressions and contoured portions may replicate a natural wood, paneled door. Similarly, steel sheets and cross-linked polymer compositions, frequently reinforced with fiberglass, may be formed suitable for use as a molded door skin from which a door may be manufactured.

With respect to conventional doors, molded door skins may be adhesively secured to a wood frame support structure to produce a finished door. Rails and stiles forming the frame provide additional structural support for the door. Such doors are well known in the art, and provide consumers with an aesthetically appealing, yet cost efficient alternatives to traditional, solid wood doors.

It is difficult to reverse mold and to emboss deep draws into a fiberboard panel due to stretching and breaking of the fibers. A reverse molded fiberboard sheet is stretched more on its visible outer surface than on its interior surface (surface in contact with a raised mold surface) making reverse molding much more difficult when attempting to provide sharp, crisp design detail in a raised panel that simulates natural wood millwork. More recently, a reverse molded product has been engineered that allows for above-plane profiling, such as disclosed in U.S. Pat. No. 6,588,162, which is incorporated herein by reference, and the assignee of which is the assignee hereof.

There continues to be a growing demand for highly detailed above plane profiling designs, yet these products are more costly to produce. The use of existing high throughput methods for assembling doors is a necessity for minimizing manufacturing costs for above plane detailing. This necessitates using conventional hot or cold press processing where direct contact between skins and framing is a critical constraint, not easily accomplished when dealing with above plane profiling elements. In particular, conventional doors having below plane profiles are aligned one on top of another in a press. Because the detailing is below plane, the requisite contact between the planar portions of the door to the wooden frame is made. However, when pressing doors having above plane profiling, spacers are typically used to insure contact is made at the peripheral portions of the door skin to the frame. This increases the costs of processing such doors.

Another problem associated with above plane wood composite articles is in stacking a plurality of molded articles for efficient shipping. Because of the relative fragility of the above plane decorative portions, spacers are typically used so that the decorative molded portions of one article do not make excessive contact with an adjacently stacked article. The resulting stack can be quite heavy, in excess of several hundred pounds, so substantial force is applied to the door skins toward the bottom of the stack. Moreover, due to the contour, adjacent skins will typically make contract at a plurality of relatively small locations, thus causing substantial pressure to be exerted at those locations.

The present invention provides a solution to these competing interests by generating two differing but complementary profiles, one for a first side of the door or door skin and one for the opposite side of the door or door skin where each allows and fits onto the other, while still providing direct contact in the stile and rail zones of the door in order to permit use of conventional door layup practices.

In particular, the present invention is based on the recognition that both sides on surface profiles of a molded skin door do not have to be identical to the other. In particular, it is rare that both sides of a door are visible at the same time. Conventional practice reflects the history of construction materials using solid wooden stiles and rails and panel components, which generated identical appearances on both sides of typical passage doors as a default. The present invention departs from the conventional practice in the prior art, which historically yielded identical appearances on both sides.

SUMMARY OF THE INVENTION

A first aspect of the present invention pertains to a molded wood composite, comprising a front side, a back side, and a perimeter frame. The front side is substantially planar and includes a first pattern thereon, wherein a first portion of the first pattern is disposed above the plane of the front side and a second portion of the first pattern is disposed below the plane of the front side. The back side is substantially planar and includes a second pattern thereon, wherein a first portion of the second pattern is disposed above the plane of the back side and a second portion of the second pattern is disposed below the plane of the back side. The first pattern of the front side is configured to allow a second pattern on an adjacent back side to be nested there against so that peripheral portions of said back side contact the perimeter frame.

A second aspect of the present invention pertains to a molded wood composite, comprising a front side, a back side, and a perimeter frame. The front side is substantially planar and includes a first pattern thereon, wherein a first portion of the first pattern is disposed above the plane of the front side and a second portion of the first pattern is disposed below the plane of the front side. The back side is substantially planar and includes a second pattern thereon. The second pattern is asymmetrical to the first pattern of the front side. The first pattern of the front side is configured to allow a second pattern on an adjacent back side door to be nested there against so that peripheral portions of said back side contact the perimeter frame.

A third aspect of the present invention pertains to a stack of doors, comprising a first door including a front side, a back side, and a perimeter frame. The front side is substantially planar and includes a first pattern thereon, wherein a first portion of the first pattern is disposed above the plane of the front side and a second portion of the first pattern is disposed below the plane of the front side. The back side is substantially planar and includes a second pattern thereon. The second pattern is asymmetrical to the first pattern of the front side. A second, adjacent door has a front side, a back side and a perimeter frame. The back side of the second door is configured to allow the first pattern of the front side of the first door is to be nested there against so that the perimeter frames on the first and second doors are in direct contact with one another.

A fourth aspect of the present invention pertains to a stack of door skins. A first, planar door skin has at least one panel thereon. The at least one panel includes a first pattern, wherein a first portion of the first pattern is disposed above a plane of the first door skin and a second portion of the first pattern is disposed below the plane of the first door skin. A second, planar door skin has at least one panel thereon. The at least one panel includes a first pattern thereon, wherein a first portion of the first pattern is disposed above a plane of the second door skin and a second portion of the first pattern is disposed below the plane of the second door skin. The first pattern of the first door skin and the first pattern of the second door skin are nested thereagainst and the second pattern of the first door skin and the second pattern of the door skin are nested thereagainst.

BRIEF DESCRIPTION OF THE DRAWING FIGURES

DETAILED DESCRIPTION OF THE PREFERRED EMBODIMENT(S)

Figure 1:
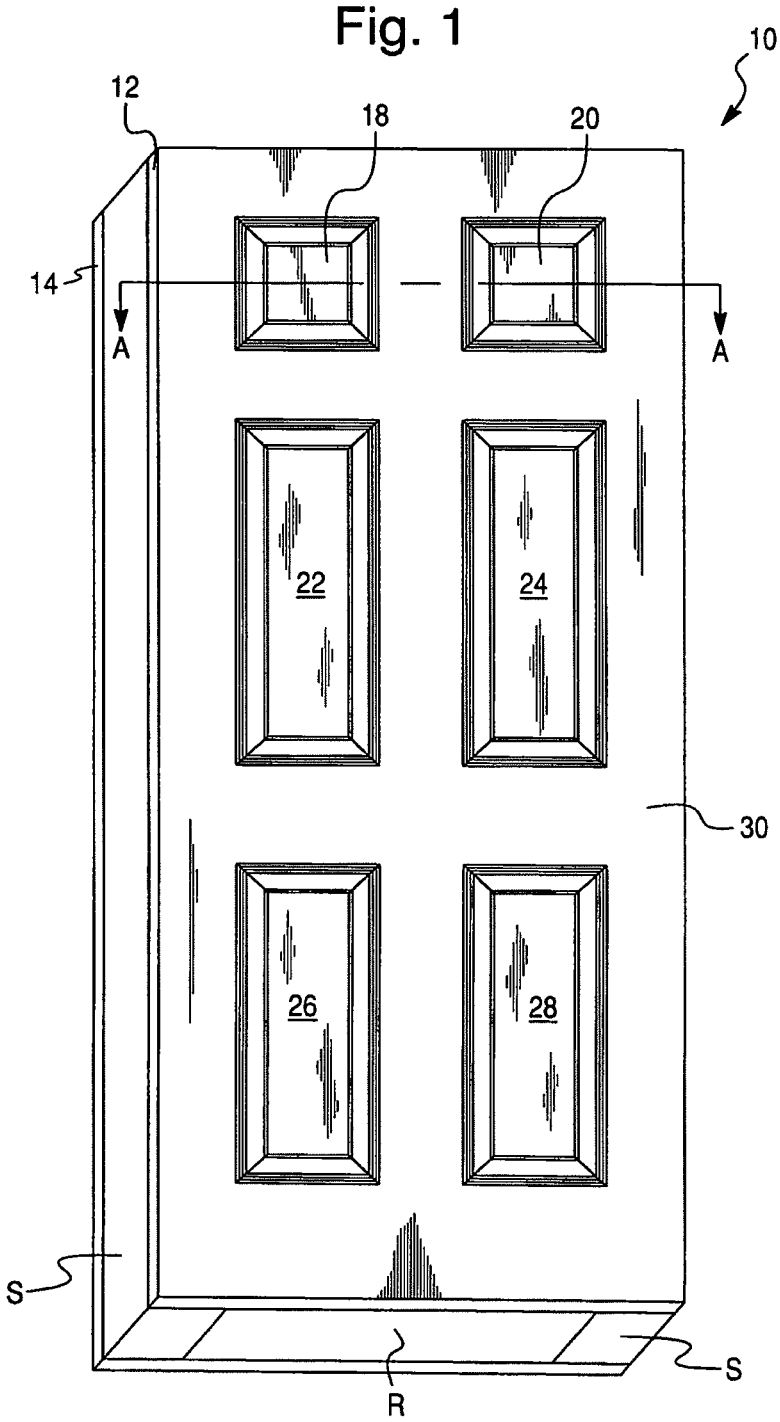
FIG. 1 is a front perspective view of a door according to an embodiment of the present invention.

In the preferred embodiments shown in the drawings, the molded wood articles of the present invention are assembled into a multi-panel door, or, more preferably, as a door skin to be laminated or otherwise adhered to a core, frame or support substrate, on both major surfaces, to simulate a solid, natural wood door, e.g., an interior or exterior passage door, as shown in FIG. 1, or a cabinet door. It should be understood, however, that the principles of the present invention apply to much more than the manufacture of doors or door skins and apply to any molded manmade composite wood article. Examples of other composite, molded wood articles that are capable of being manufactured in accordance with the principles of the present invention include decorative hardboard; interior and exterior siding; decorative interior wall panelling; structural cores; roofing material; crating structures; and the like.

A surface portion of the articles of the present invention should be formed from cellulosic material, such as fibrillated cellulosic fibers, or cellulosic particles and a binder capable of adhering the cellulosic material together into a structurally stable article. The cellulosic fibers, whether in the form of refined, fibrillated fibers, or in the form of discrete particles, can be molded and adhered together with natural or synthetic binders to provide aesthetically pleasing contours and texture in all exterior, visible surfaces, including the depression-interior inclined wall surfaces. The articles of the present invention can be molded as a thin, e.g., 0.1 to 0.2 inch thick door skin, and later laminated to a support structure.

The present invention is particularly applicable to reverse molded products that include above-plane profiling. In the case of doors, the present invention recognizes that doors can be made that have the same profiling, and both include above-plane profiling, yet the doors can be nested against one another without the need for spacers. In particular, the door configuration is such that the front and back skins are not identical to each other, because the design portions of the door are not in contact when adjacent doors are in contact with one another.

Turning now to the drawings, and initially to FIG. 1, there is illustrated a door, generally designated by reference numeral 10, shown horizontal, as assembled, that includes an upper door skin 12, and lower door skin 14 secured to opposite major surfaces of a door frame or interior support structure 16. The door skins 12 and 14 are molded separately to impart desired aesthetic surface contours to the visible outer surfaces that correspond to contours essentially identical to contours of a mold cavity (not shown). The door skins 12 and 14 then can be secured, e.g., adhesively, to a suitable core or frame structure 16. Preferably, the frame 16 includes a pair of rails R and a pair of stiles S, typically manufactured from wood.

After adhesive secures the skins 12, 14 to the frame 16, a number of doors 10 are assembled in a press, and held for a period of time to allow for the adhesive, typically polyvinyl acetate ("PVA"), to cure and thereby bond the door skins 12, 14 to frame 16. As described in more detail below, the configurations of the doors 10 are such that spacers are not needed between the doors, even though adjacent doors 10 have above-plane profiling.

The exemplary door skins 12,14 shown in FIG. 1 are molded to simulate a multi-panel door surface, and the preferred embodiment shown in FIG. 1 contains six molded rectangular portions 18, 20, 22, 24, 26 and 28. The rectangular portions 18, 20 22, 24, 26, and 28 are surrounded by substantially planar surfaces of the door, lying in a common plane 30. When held in a press, it is important that adjacent doors 10 make contact in the common plane 30, and that the molded portions 18, 20, 22, 24, 26, and 28 make little to no contact with the molded portions of an adjacent door. Planar contact of the peripheral portions of the skins 12, 14 with frame 16 is desired in order to assure a strong bonding of the skins 12, 14 to frame 16 after the PVA cures.

Figure 2A:
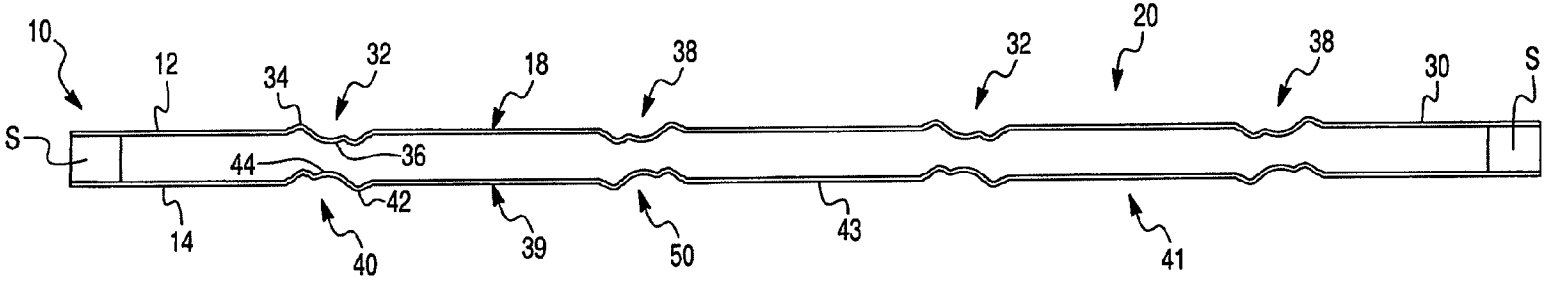
FIG. 2A is a cross-sectional view of the door of FIG. 1 taken along line A-A and viewed in the direction of the arrows.
Figure 2B:
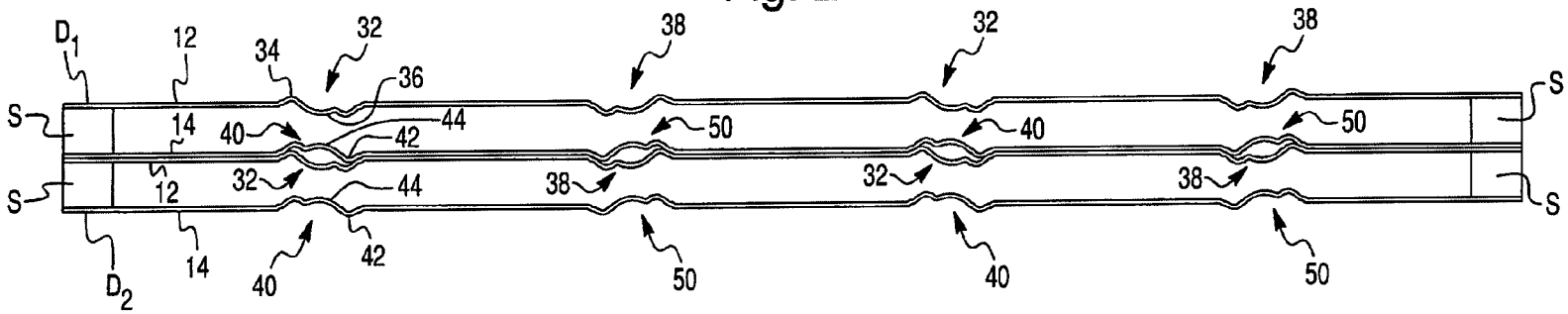
FIG. 2B is a cross-sectional view of two doors as embodied in FIG. 2A stacked adjacent to each other according to an embodiment of the present invention.

With reference to FIGS. 2A and 2B, the configuration of the two panels 18 and 20 will be described in more detail. Although details of panels 22, 24, 26, and 28 are not shown in this figure, it should be understood that they can be configured to be similar to the panels 18 and 20. With reference to FIG. 2A, a first embodiment of a door 10 of the present invention includes a front skin 12 and a back skin 14. The front skin 12 is substantially planar and includes the panel portions 18 and 20. Panel portion 18 includes a first pattern 32 recessed therein. A first portion 34 of the first pattern 32 is disposed above the plane 30 of the front skin 12. A second portion 36 of the first pattern 32 is disposed below the plane 30 of the front skin 12. The front skin 12 also includes an additional pattern 38, which is a mirror image of the first pattern 32. The additional pattern 38 completes the panel 18. The panel 20 has a configuration similar to panel 18, with a first pattern 32 and second pattern 38.

The back skin 14 is substantially planar and preferably includes the same number of panel portions as the front skin 12. In the preferred embodiment, there are six panel portions. FIG. 2A illustrates two of the panels 39 and 41. Similar to front skin 12, panel 39 of back skin 14 includes a second pattern 40 therein. A first portion 42 of the second pattern 40 is disposed above the plane 43 of the back side 14 and a second portion 44 of the second pattern 40 is disposed below the plane 43 of the back side 14. The back skin 14 also includes an additional pattern 50, which is a mirror image of the second pattern 40, and together with pattern 40 forms the panel 39. Similarly, panel 41 includes a second pattern 40 and an additional pattern 50, which is similar in configuration to the panel 39. Preferably, the configuration of the back skin 14 is asymmetrical to the configuration of the front skin 12.

With reference to FIG. 2B, two identically sized doors D1, D2 are stacked adjacent to each other. First pattern 32 of front skin 12 of a first door D1 is configured to allow a second pattern 40 of adjacent overlay door D2 to be nested there against so that peripheral portions of skins 12, 14 of adjacent doors D1, D2 are in direct contact with the associated frame 16 and lie flat against each other. Preferably, the second pattern 40 of the back skin 14 is a mirror reverse image of the first pattern 32 of the front side 12. In addition, the pattern 38 of the door D2 is configured to allow the pattern 50 of adjacent overlay door D1 to be nested. For a six panel door, this pattern is repeated with the upper right panels 20 and 41, as well as at the center two patterns, and the lower two patterns. However, it should be understood that as few as one or more than six panels may be used, in accordance with design preference and application.

In accordance with the present invention, two adjacent doors can be stacked without the use of spacers. Preferably, both skins 12 and 14 are asymmetrical and have above and below plane portions, yet allow an adjacent door to be nested there against. Because the skins 12 and 14 are asymmetrical, they are preferably made in two different die sets and thereafter attached to a perimeter frame with glue by cold or hot pressing, as described above. Because of the geometries of the skins 12 and 14, the doors D1 and D2 can be stacked without causing profiling deflection or damage from facing to facing. Those skilled in the art recognize that a stack of doors can be quite heavy, with the result that the lowermost door in the stack bears a substantial load that may cause deformation, cracking or other damage to the lowermost door. In addition, the assembly yields a door with two different but compatible and desirable sides for visual appearance.

As shown in FIG. 2B, two similarly sized doors D1 and D2 can be stacked, thereby minimizing contact at the above-plane processed portions. In addition, additional doors can be stacked adjacent each other without the need for spacers for shipping or for cold or hot pressing. In particular, as many as 60 doors can be inserted into a press for cold or hot pressing without special handling and filler pieces, which provides a cost competitive advantage.

The present invention also promotes better options in placing cores of many types from semi-solid, to solid, to fire and sound resistant properties, due to the thicker inner cross-section being available while holding the similar total depth of draw that is typically found in conventional below plane prior art molded HDF facing products.

Figure 3A:
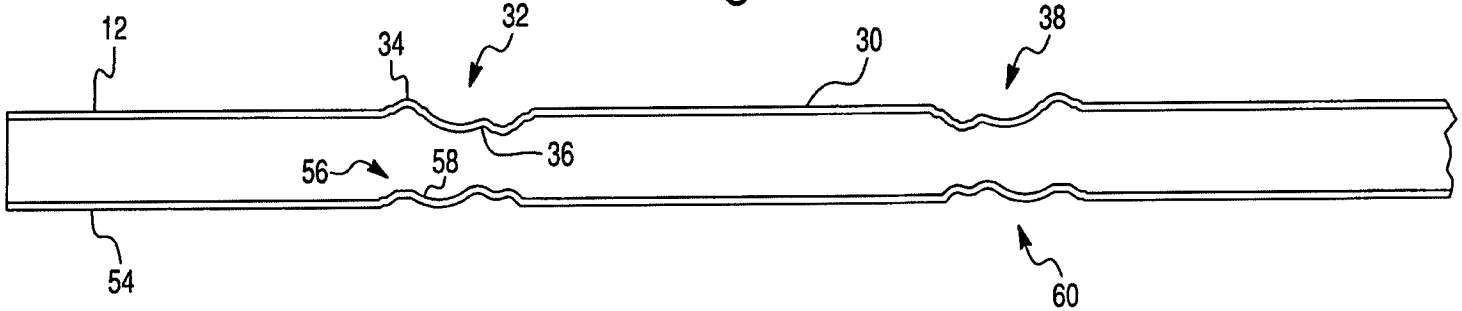
FIG. 3A is a fragmentary, cross-sectional view of a door according to an alternative embodiment of the present invention.
Figure 3B:
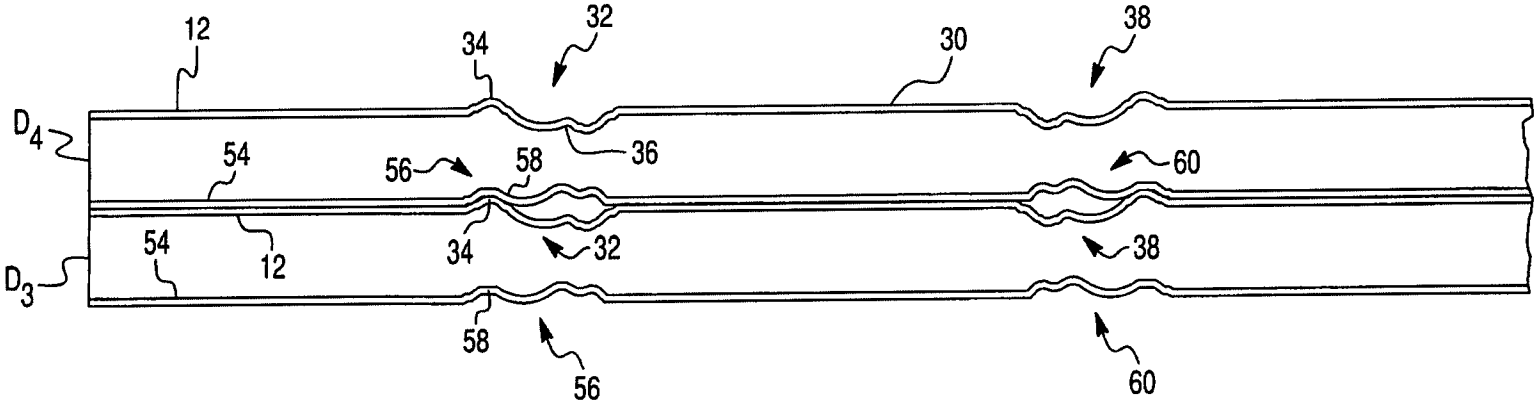
FIG. 3B is a fragmentary, cross-sectional view of two doors as embodied in FIG. 3A stacked adjacent to each other according to an alternative embodiment of the present invention.

With reference to FIGS. 3A and 3B, a second embodiment of the present invention is illustrated. In particular, the front skin 12 of FIGS. 3A and 3B is identical to the front skin 12 disclosed and described in connection with FIGS. 2A and 2B. In particular, the front skin 12 is substantially planar and includes a first pattern 32 thereon. A first portion 34 of the first pattern 32 is disposed above the plane 30 of the front skin 12. A second portion 36 of the first pattern 32 is disposed below the plane 30 of the front skin 12. The front skin 12 also includes an additional pattern 38, which is a mirror image of the first pattern 32.

However, the back skin 54 is different from the back skin 14 disclosed and described in connection with FIGS. 2A and 2B. In particular, the back skin 54 includes a pattern 56 that includes only a below plane portion 58 of door D4, and does not include an above plane portion. The below plane portion 58 is configured to receive adjacent raised portion 34 of an adjacent door D3, as shown in FIG. 3B. The back skin 54 also includes an additional pattern 60, which is a mirror image of the pattern 56. For a six panel door, this pattern is repeated at the upper right panel, the center two patterns, and the lower two patterns. However, it should be understood that as few as one or more than six panels may be used, in accordance with design preference and application.

Preferably, doors D3 and D4 are identical so that a front skin 12 of door D3 lies adjacent to the back skin 54 of door D4, wherein the raised portion 34 of door D3 is nested against the below plane portion 58 of door D4. Thus, contact is maintained at and along the perimeter frame, particularly at the rail and stile locations. As shown in FIG. 3B, two similar doors D3 and D4 can be stacked, thereby minimizing contact at the above-plane portions. However, it should be understood that numerous doors can be stacked adjacent each other without the need for spacers for shipping or for cold or hot pressing.

Figure 4A:
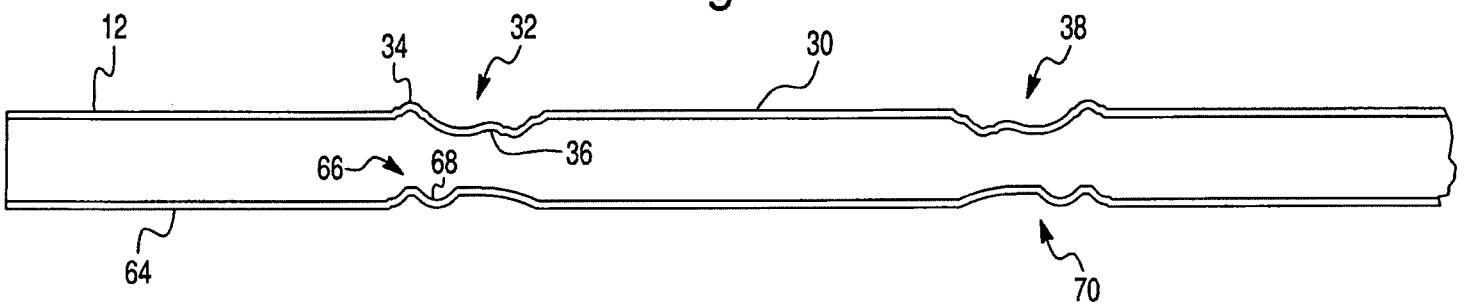
FIG. 4A is a fragmentary, cross-sectional view of a door according to an alternative embodiment of the present invention.
Figure 4B:
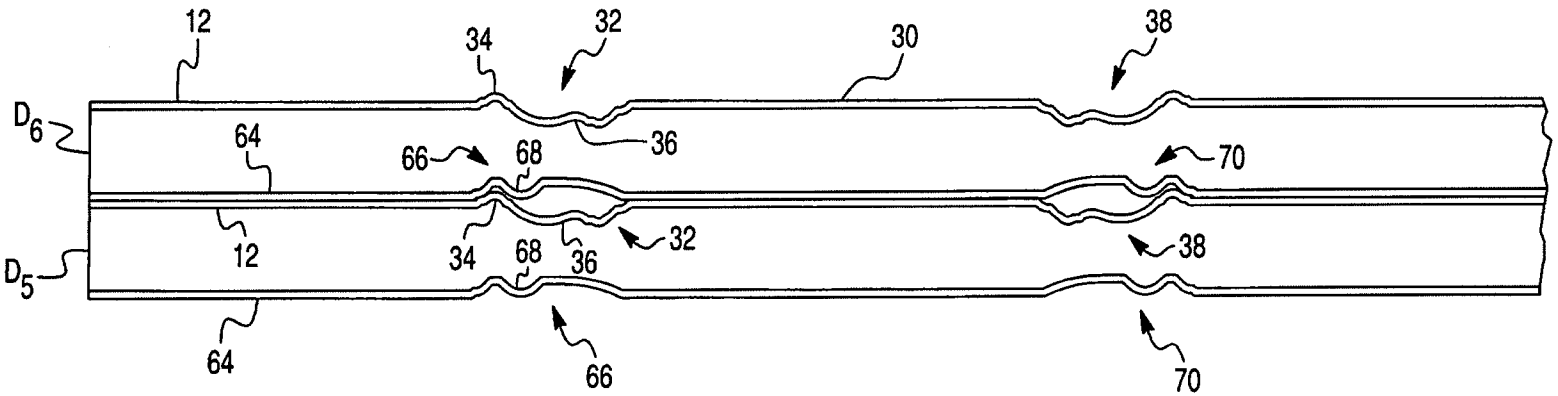
FIG. 4B is a fragmentary, cross-sectional view of two doors as embodied in FIG. 4A stacked adjacent to each other according to an alternative embodiment of the present invention.

With reference to FIGS. 4A and 4B, a third embodiment of the present invention is illustrated. In particular, the front skins 12 of the doors of FIGS. 4A and 4B are identical to the front skin 12 disclosed and described in connection with FIGS. 2A, 2B, 3A and 3B. In particular, the front skin 12 is substantially planar and includes a first pattern 32 thereon. A first portion 34 of the first pattern 32 is disposed above the plane 30 of the front skin 12. A second portion 36 of the first pattern 32 is disposed below the plane 30 of the front skin 12. The front skin 12 also includes an additional pattern 38, which is a mirror image of the first pattern 32.

However, the back skin 64 is different than the back skin 14 disclosed and described in connection with FIGS. 2A and 2B, and is similar to the back skin 54 described in connection with FIGS. 3A and 3B. In particular, the back skin 64 includes a pattern 66 that includes only a below plane portion 68, and does not include an above plane portion. The below plane portion 68 is configured to receive adjacent raised portion 34 of an adjacent door, as shown in FIG. 4B. The back skin 64 also includes an additional pattern 70, which is a mirror image of the pattern 66. For a six panel door, this pattern is repeated at the upper right panel, center two patterns, and the lower two patterns. However, it should be understood that as few as one or more than six panels may be used in accordance with design preference and application.

The aesthetics provided by back skin 64 is more conventional than the aesthetics achieved by back skins 14 and 54. Preferably, doors D5 and D6 are identical so that a front skin 12 of door D5 lies adjacent to the back skin 64 of door D6, wherein the raised portion 34 of door D5 is nested against the below plane portion 68 of door D6. Thus contact is maintained at and along the perimeter frame, particularly along the rail and stile locations. As shown in FIG. 4B, two similar doors D5 and D6 can be stacked, thereby minimizing contact at the above-plane processed portions. However, it should be understood that numerous doors can be stacked adjacent each other without the need for spacers for shipping or for cold or hot pressing.

Figure 5:
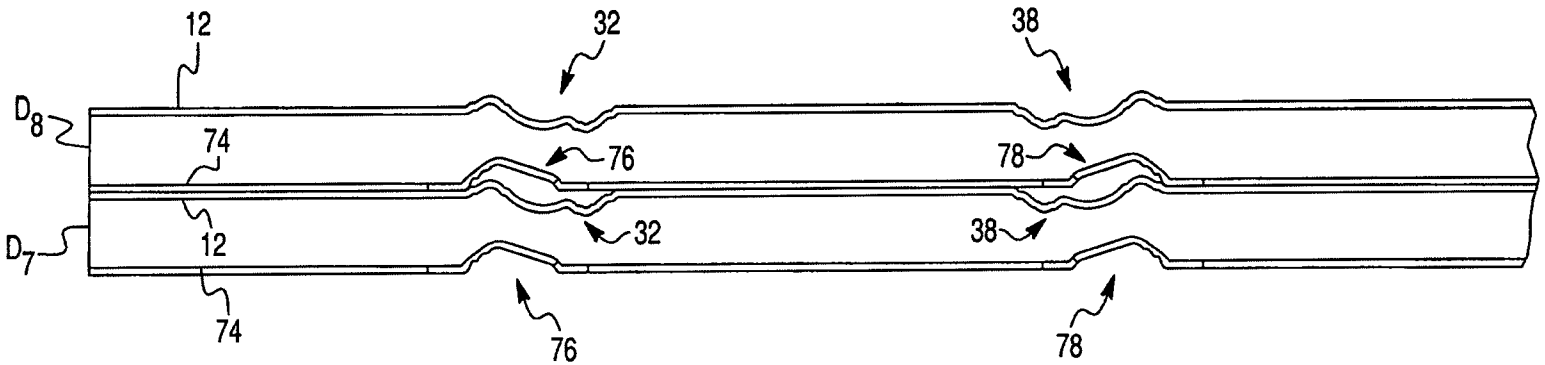
FIG. 5 is a fragmentary, cross-sectional view two doors stacked adjacent to each other according to an alternative embodiment of the present invention.

With reference to FIG. 5, a stack of doors D7 and D8 is illustrated. Preferably, doors D7 and D8 are identical in configuration, having front skins 12 as described above. However, the back skins 74 of doors D7 and D8 include a pattern 76 that has detailed design contours, including adjacent curved and planar portions, e.g., bead and cove. Details of the bead and cove configuration are disclosed in U.S. Pat. No. 6,200,687, which is incorporated herein by reference. The front skin 12 of the door D7 includes a pattern 32 that is shaped to allow the bead and cove pattern 76 to be nested there against, while maintaining contact at and along the perimeter frame. In addition, the additional pattern 38 of front skin 12 of door D7 is received in a mirror image bead and cove pattern 78 of the back skin 74 of the adjacent door D8. For a six panel door, this pattern is repeated at the upper right panel, center two patterns, and the lower two patterns. However, it should be understood that as few as one or more than six panels may be used, in accordance with design preference and application.

As shown in FIG. 5, two similar doors D7 and D8 can be stacked, thereby minimizing contact at the above-plane processed portions. However, it should be understood that numerous doors can be stacked adjacent each other without the need for spacers for shipping or for cold or hot pressing.

Figure 6:
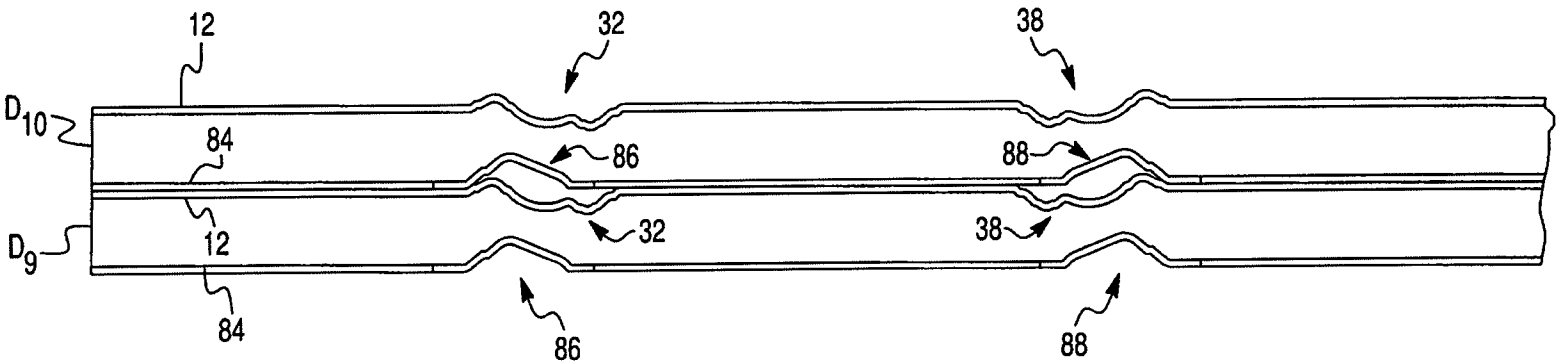
FIG. 6 is a fragmentary, cross-sectional view two doors stacked adjacent to each other according to an alternative embodiment of the present invention.

With reference to FIG. 6, a stack of doors D9 and D10 is illustrated. Preferably, doors D9 and D10 are identical in configuration and size, having front skins 12 as described above. However, the back skins 84 of doors D9 and D10 include a pattern 86 that has detailed design contours which are disclosed in U.S. Pat. No. 5,543,234, which is hereby incorporated by reference. The front skin 12 of the door D9 includes a pattern 32 that is shaped to allow the pattern 86 to be nested there against, while maintaining contact at and along the perimeter frame. In addition, the additional pattern 38 of front skin 12 of door D9 is received in a mirror image pattern 88 of the back skin 84 of the adjacent door D10. For a six panel door, this pattern is repeated at the upper right panel, center two patterns, and the lower two patterns. However, it should be understood that as few as one or more than six panels may be used, in accordance with design preference and application.

As shown in FIG. 6, two identical doors D9 and D10 can be stacked, while minimizing contact at the above-plane portions. However, it should be understood that numerous doors can be stacked adjacent each other without the need for spacers for shipping or for cold or hot pressing.

Figure 7:
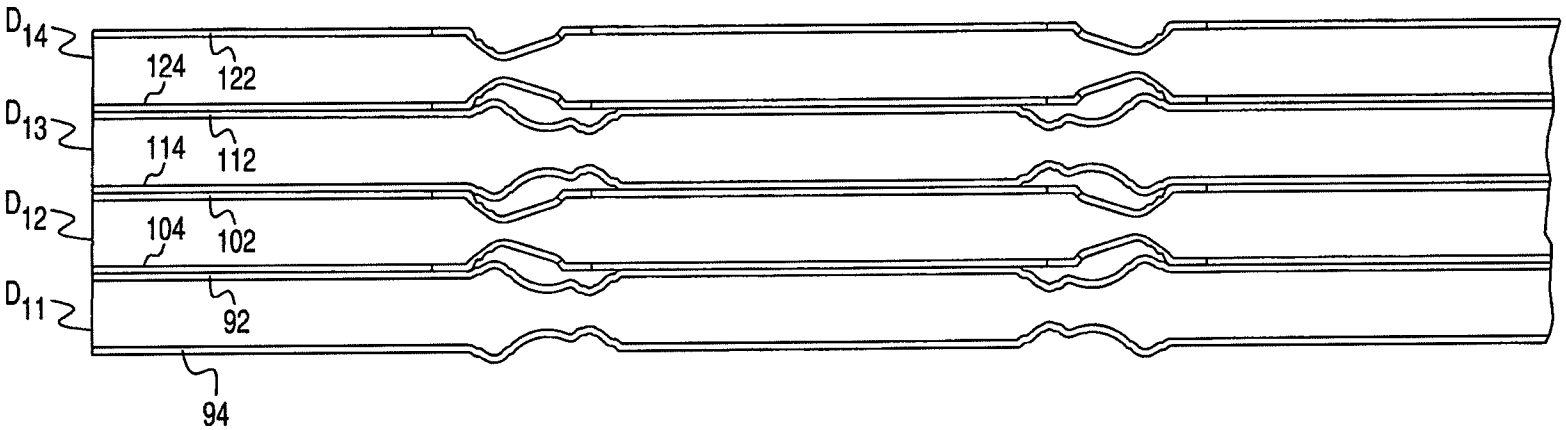
FIG. 7 is a fragmentary, cross-sectional view of doors of different configurations stacked adjacent to each other according to an alternative embodiment of the present invention.

With reference to FIG. 7, an alternative method of stacking is disclosed. In particular, differently shaped doors are stacked. For example, door D11 is designed to have front and back skins 92 and 94, respectively, which are shaped similar to front skin 12, described above. That is, the front skin 92 and back skin 94 include above and below plane portions. However, the door D11 differs from the doors described above in that the skins are symmetrical. This allows an adjacent door D12 having a back skin 104 with below plane portions to be received thereagainst. Like door D11, door D12 includes a symmetrical front skin 102, which also includes below plane portion. This allows an adjacent door D13 having above plane portions on back skin 114 to be received thereagainst. Door D13 is similar in shape to door D11, and includes a front skin 112 that is symmetrical with the back skin 114. This allows an adjacent door D14 having front skin 122 and back skin 124 to be received thereagainst. Door D14 is similar in shape to door D12, and includes two symmetrical skins having below plane portions.

However, while only symmetrical doors are shown, it should be understood that an asymmetrical door may be stacked adjacent the doors, such that respective above plane and below plane profiles are received thereagainst. For example, door D12 may include a back skin having a below plane profiling and a front skin having an above plane profiling in accordance with the present invention.

The present invention addresses various concerns associated with stacking doors having above plane detailing, and provides a cost effective solution to stacking these types of doors. In particular, the above and below plane profiling of the doors are strategically chosen so that adjacent doors can be aligned without requiring the use of spacers. As such, conventional layup practices used previously with below plane processed doors can be used.

In addition, only two mold dies are necessary for manufacturing at least three differently shaped doors, i.e., one die having above and below plane processing (skin A) and one die having below plane processing (skin B). Three different sized doors can be made with these two molds, one having two skins A, one having a skin A and a skin B, and one having two skins B. As discussed in connection with FIG. 7, these differently configured doors can be stacked so that adjacent doors do not make contact in the above-plane design details, but rather in the stile and rail zones of the door.

Figures 8, 8A:
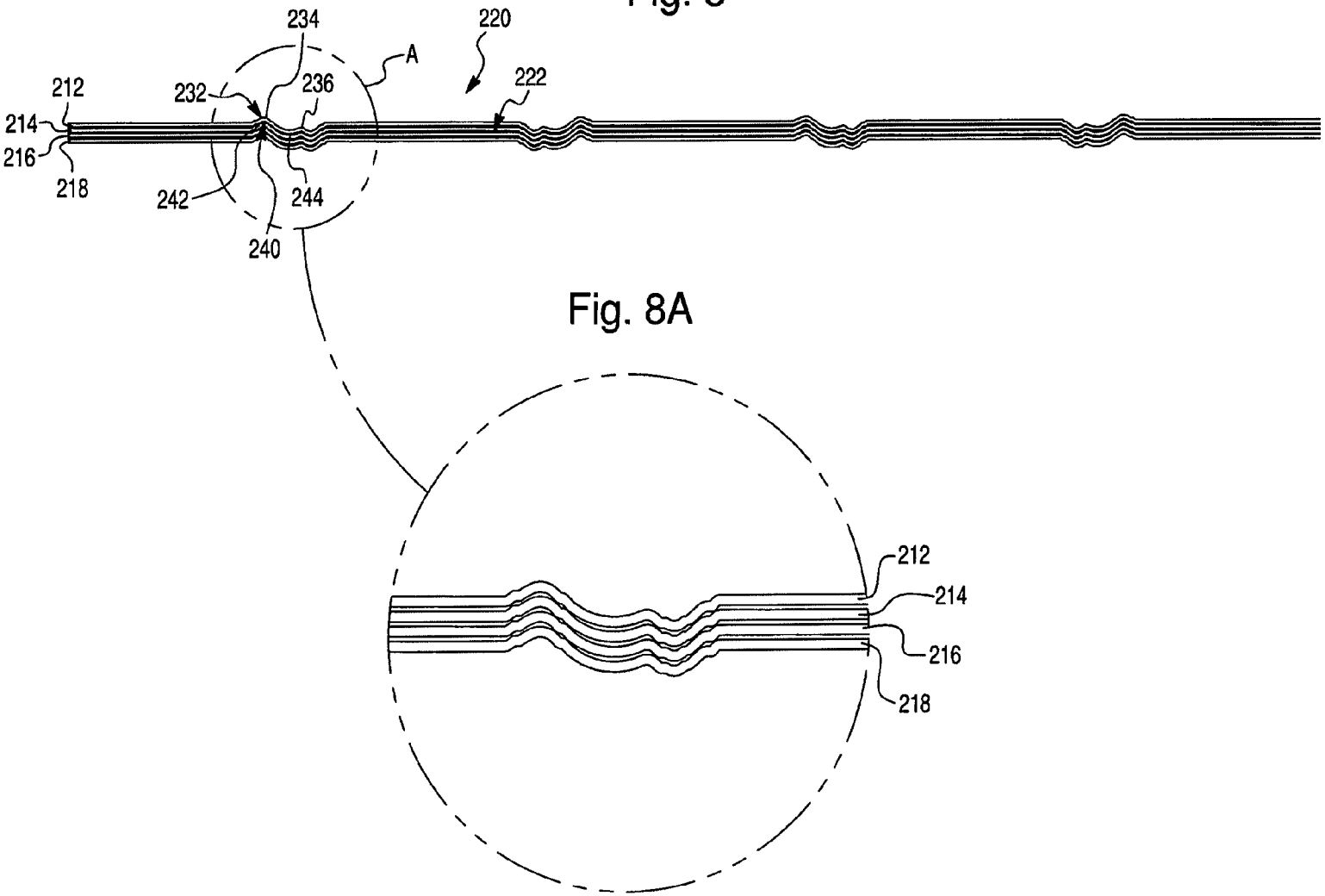
FIG. 8 is a cross sectional view of a stack of door skins according to an exemplary embodiment of the present invention.
FIG. 8A is a fragmentary, cross sectional view of the stack of door skins shown in detail A in FIG. 8.

With reference to FIGS. 8 and 8A, a stack of door skins 212, 214, 216, and 218 are illustrated. Preferably, the door skins 212, 214, 216, and 218 are identical in configuration to the door skins 12 described above. As shown in FIG. 8A, a first, planar door skin 212 has at least one panel 220 thereon which includes a first pattern 232. The first portion 234 of the first pattern 232 is disposed above a plane of the first door skin 212 and a second portion 236 of the first pattern 232 is disposed below the plane of the first door skin 212. A second, planar door skin 214 has at least one panel 222 thereon. The at least one panel 222 includes a first pattern 240 thereon, wherein a first portion 242 of the first pattern 240 is disposed above a plane of the second door skin 214 and a second portion 244 of the first pattern is disposed below the plane of the second door skin 214. The first pattern 232 of the first door skin 212 and the first pattern 240 of the second door skin 214 are nested thereagainst and the second pattern 236 of the first door skin 212 and the second pattern 244 of the second door skin 214 are nested thereagainst. The stack of doors shown in FIGS. 8 and 8A reduces the volume being shipped by eliminating void space when skins are stacked for shipment.

Certain aspects of the present invention have been explained according to preferred embodiments. However, it will be understood to one of ordinary skill in the art that various modifications and variations can be made in construction or configuration without departing from the scope or spirit of the invention. It is intended that the present invention include all such modifications and variations, provided they come within the scope of the following claims and their equivalents.

We claim:

1. A door, comprising:

a front door skin, a rear door skin, and a perimeter frame comprising a bottom edge;

said front door skin comprising a first planar area and a first pattern, wherein a first portion of the first pattern is disposed at a first distance from said bottom edge and extends above the first planar area of the front door skin and a second portion of the first pattern is disposed at a second distance from said bottom edge and extends below the first planar area of the front door skin;

said rear door skin comprising a second planar area and a second pattern, wherein a first portion of the second pattern is disposed at a third distance from said bottom edge and extends below the second planar area of the rear door skin and a second portion of the second pattern is disposed at a fourth distance from said bottom edge and extends above the planar area of the rear door skin;

wherein said first and third distances are substantially equal and said second and fourth distances are substantially equal, and wherein said first pattern of said front door skin is configured to allow said second pattern of said rear door skin of an identical second door to be nested therein.

2. The door of claim 1, wherein said front door skin and said rear door skin each possess substantially uniform thicknesses.

3. The door of claim 1, wherein the door is a first door and when in the adjacent, nesting relationship said planar area of said first door is in flush contact with said planar area of the identical second door.

4. The door of claim 3, wherein said first and second patterns surround respective panels.

5. A door, comprising:

a perimeter frame comprising opposite first and second frame sides and a top edge;

a first molded wood composite door skin having a first periphery secured to said first frame side, said first door skin comprising a first planar area and a first contoured pattern, said first contoured pattern comprising a first convex portion extending relative to said first planar area, said first convex portion being located a first distance from said top edge, and a first concave portion extending relative to said first planar area, said first concave portion being located a second distance from said top edge; and a second molded wood composite door skin having a second periphery secured to said second frame side, said second door skin comprising a second planar area and a second contoured pattern, said second contoured pattern comprising a second convex portion extending relative to said second planar area, said second convex portion being located a third distance from said top edge, and a second concave portion extending relative to said second planar area, said second concave portion being located a fourth distance from said top edge;

wherein said first and fourth distances are substantially equal and said second and third distances are substantially equal, and wherein said door is a first door positionable into adjacent, nesting relationship with a substantially identical second door so that when in the nesting relationship said first convex portion of said first door nests with said second concave portion of the identical second door.

6. The door of claim 5, wherein said perimeter frame comprises a pair of stiles and a pair of rails.

7. The door of claim 5, wherein said first contoured pattern is non-identical to said second contoured pattern.

8. The door of claim 7, wherein said second contoured pattern is a mirror reverse image of said first contoured pattern.

9. A stack of doors, comprising:

a first door comprising;

a perimeter frame having opposite first and second frame sides;

a front door skin having a periphery secured to said first frame side, said front door skin comprising a first planar portion and a first contoured pattern, said first contoured pattern comprising a convex portion extending outward relative to said first planar portion and a first concave portion extending inward relative to said first planar portion; and a first rear door skin having a periphery secured to said second frame side, said first rear door skin comprising a second planar portion and a second contoured pattern; and a second door comprising;

a second rear door skin comprising a third planar portion and a third contoured pattern having a second concave portion configured to nest with the first convex portion of said front door skin when placed in a stacked relationship therewith.

10. The stack of doors of claim 9, wherein said first and second doors are substantially identical in shape.

11. The stack of doors of claim 9, wherein said first door and said second door are different in shape.

12. The stack of doors of claim 9, wherein said first and second contoured patterns are non-identical.

13. The stack of doors of claim 9, wherein said first and second contoured patterns are identical to one another and wherein said third contoured pattern of said second door is non-identical to said first and second contoured patterns of said first door.

14. The stack of doors of claim 9, wherein:

said front door skin comprises a molded wood composite; and said first and second rear door skins comprise a molded wood composite.

15. A door, comprising:

a perimeter frame having opposite first and second frame sides;

a molded wood composite front door skin secured to said first frame side, said front door skin comprising a first planar portion and a first pattern said first pattern comprising:

a first front bead and cove configuration wherein the first front bead portion is convex relative to said first planar portion and the first front cove portion is concave relative to said first planar portion; and a second front bead and cove configuration wherein the second front bead portion is convex relative to said first planar portion and the second front cove portion is concave relative to said first planar portion; and a molded wood composite rear door skin having a periphery secured to said second frame side, said rear door skin comprising a second planar portion and a second pattern comprising:

a first rear bead and cove configuration wherein the first rear bead portion is convex relative to said second planar portion and the first rear cove portion is concave relative to said second planar portion; and a second rear bead and cove configuration wherein the second rear bead portion is convex relative to second planar portion and the second rear cove portion is concave relative to said second planar portion, wherein said door is a first door positionable into adjacent, nesting relationship with an identical second door so that when in the nesting relationship the convex first front bead portion of said first door nests with the concave second rear cove portion of the identical second door.

* * * * *